United States Patent [19]

Froutzis

[11] Patent Number: 4,754,943

[45] Date of Patent: Jul. 5, 1988

[54] SEAT PEDESTAL

[76] Inventor: Andrew Froutzis, 53224 Marina Dr., Elkhart, Ind. 46514

[21] Appl. No.: 137,154

[22] Filed: Dec. 23, 1987

[51] Int. Cl.[4] ..... F16M 11/20

[52] U.S. Cl. ..... 248/188.1; 248/176; 248/346; 248/423; 248/544; 403/331; 403/388

[58] Field of Search ..... 248/188.1, 424, 176, 248/346, 158, 423, 424, 544; 403/388, 331, 353; 297/311, 15

[56] References Cited

U.S. PATENT DOCUMENTS

| | | | |
|---|---|---|---|
| 3,153,524 | 10/1964 | Greenfield et al. | 248/158 |
| 3,908,946 | 9/1975 | George et al. | 248/158 X |
| 4,241,893 | 12/1980 | Koutsky et al. | 248/425 |
| 4,307,865 | 12/1981 | MacCready | 248/424 |
| 4,316,634 | 2/1982 | Roesler | 297/349 |
| 4,570,997 | 2/1986 | Tanizaki et al. | 297/349 |
| 4,600,239 | 7/1986 | Gerstein et al. | 297/349 |

*Primary Examiner*—Ramon O. Ramirez
*Attorney, Agent, or Firm*—Thomas J. Dodd

[57] ABSTRACT

A pedestal for supporting a seat. The pedestal includes a tubular support connected to a raised portion of the base through locking tabs and a peripheral flap located on the lower plate member which carries the tubular support.

2 Claims, 2 Drawing Sheets

SEAT PEDESTAL

SUMMARY OF THE INVENTION

This invention relates to a seat pedestal.

Seat pedestals are common useful articles for supporting chairs, sofas, or the like above the ground. These pedestals generally include bases which are attached to the floor of a vehicle or the home and plate-like supports for the chair or other item of furniture. The plate supports are either fastened directly to the base, or, more ideally are detachably fastened to the base by removable fasteners, to allow selective replacement of parts.

The seat pedestal of this invention includes a support plate which is connected to the base through mating tabs and holes, along with a return bent lip and a conventional screw fastener. This connection produces a seat pedestal which is easily disassembled and further provides additional strength against linear shear and vibrational forces which tended to damage the prior art pedestals. Examples of prior art seat pedestals are seen in U.S. Pat. Nos. 1,693,770; 1,735,321; 1,999,949; 2,845,990; 3,044,829; 3,385,550; 3,503,523; 3,593,954; 3,522,202; 3,922,029; 4,076,346; 4,134,565; 4,226,398; 4,241,893; 4,316,634; 4,570,997; and 4,600,239.

Accordingly, it is an object of this invention to provide for an improved seat pedestal.

Another object of this invention is to provide for a seat pedestal having detachable parts which is durable and resistive to shear forces.

Another object of this invention is to provide for a seat pedestal which is economical and which is easily assembled and disassembled.

Other objects of this invention will become apparent upon a reading of the following description.

BRIEF DESCRIPTION OF THE DRAWINGS

A preferred embodiment has been depicted to illustrate the principles of the invention wherein.

DESCRIPTION OF THE PREFERRED EMBODIMENT

Figure 1:
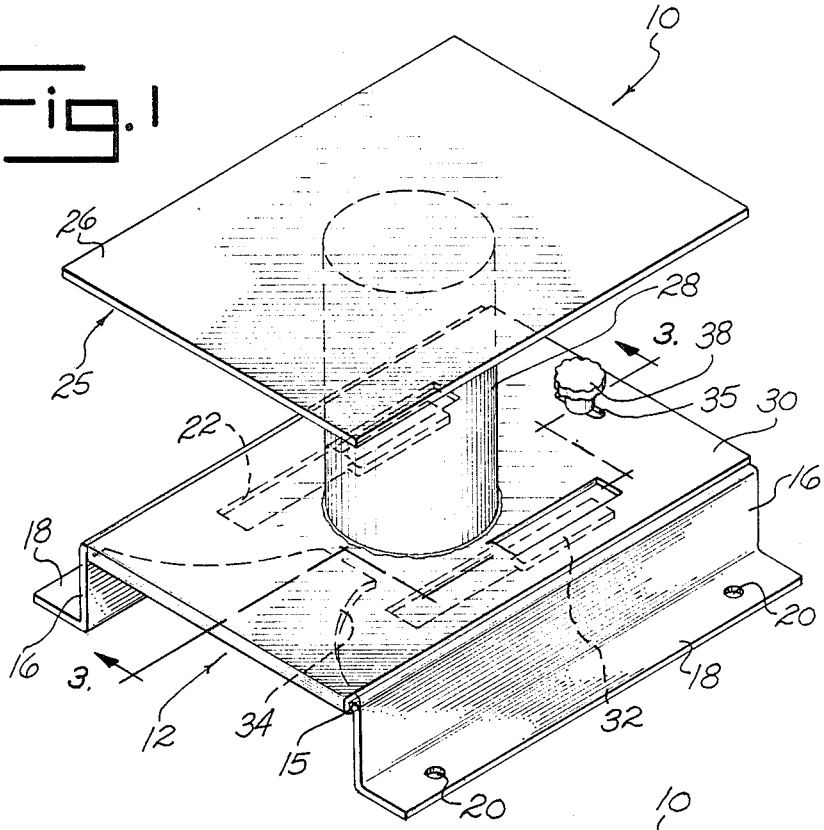
FIG. 1 is a perspective view of the seat pedestal in its assembled form.

The preferred embodiment herein described is not intended to be exhaustive or to limit the invention to the precise form disclosed. It is chosen and described to explain the principles of the invention and its application and practical use to enable others skilled in the art to utilize the invention.

Referring now to the drawings, reference numeral 10 refers generally to the seat pedestal of this invention. Pedestal 10 includes a base member 12, preferably of the type shown which includes an upper base plate 14 and a pair of spaced peripheral L-shaped legs 16. Each leg 16 includes a foot part 18 which defines bores 20 through which fasteners (not shown) extend to anchor base member 12 to a floor (not shown) in conventional fashion. Base member upper plate 14 defines spaced holes 22 preferably of the rectangular configuration shown, although other configurations are possible, and a bore 24, each extending completely through the upper plate.

Pedestal 10 also includes a seat support assembly 25, which has a chair support plate 26 supported atop a generally tubular support member 28. Support plate 26 is for supporting a chair, sofa, or the like and may be anchored to tubular support member 28 or may be rotatively connected thereto in conventional fashion. Support member 28 is fixedly connected, as by welding, to a lower guide plate 30 as shown in FIGS. 1–2.

Figure 3:
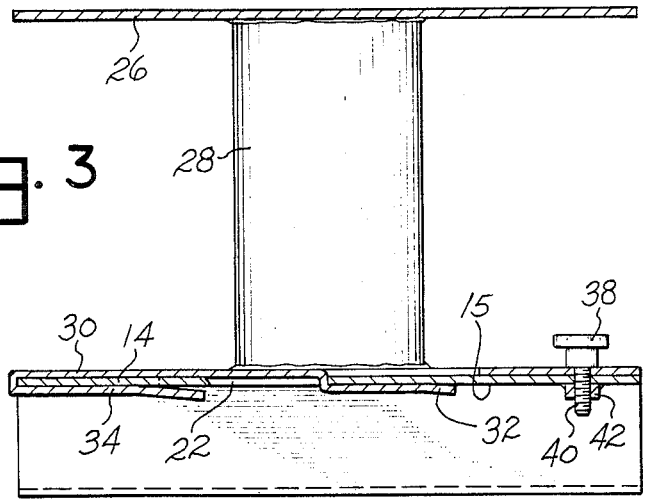
FIG. 3 is a sectional view taken along line 3—3 of FIG. 1.
Figure 4:
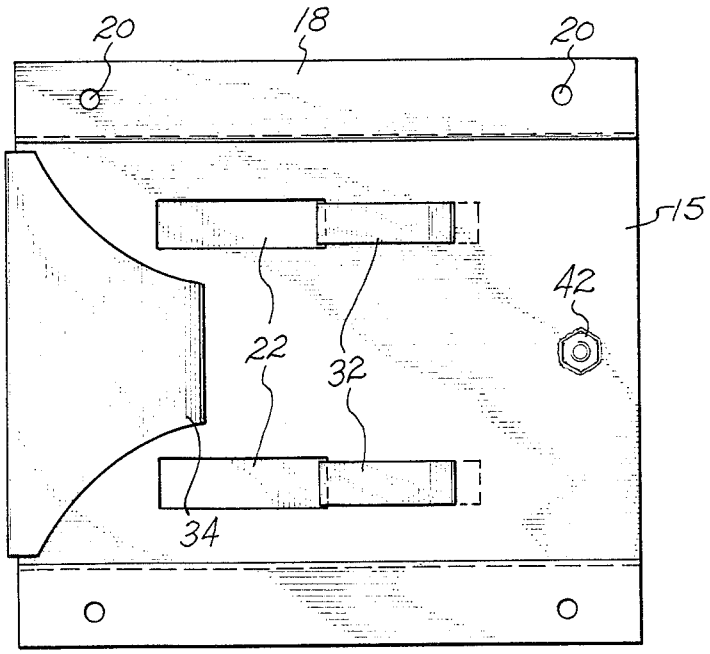
FIG. 4 is a bottom plan view of the pedestal base, illustrating the tabs and lip of the support plates.
Figure 5:
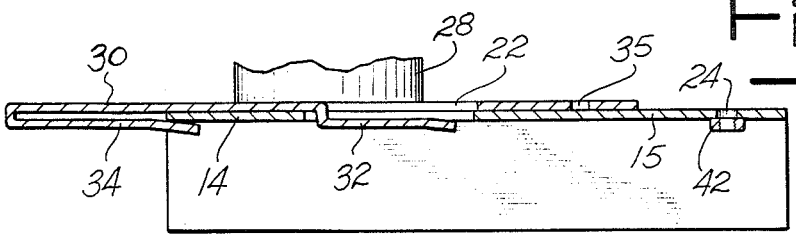
FIG. 5 is a sectional view similar to FIG. 3 illustrating support plate removal.

Guide plate 30 includes downwardly extending tabs 32 formed by conventional punching process, which mate with holes 24 as shown in FIG. 3. Guide plate 30 further includes a peripheral return bent lip 34 which fits under an end edge 15 of upper base plate 14 to secure the support member 28 and support plate 26 against sliding movement relative to base member 12.

Figure 2:
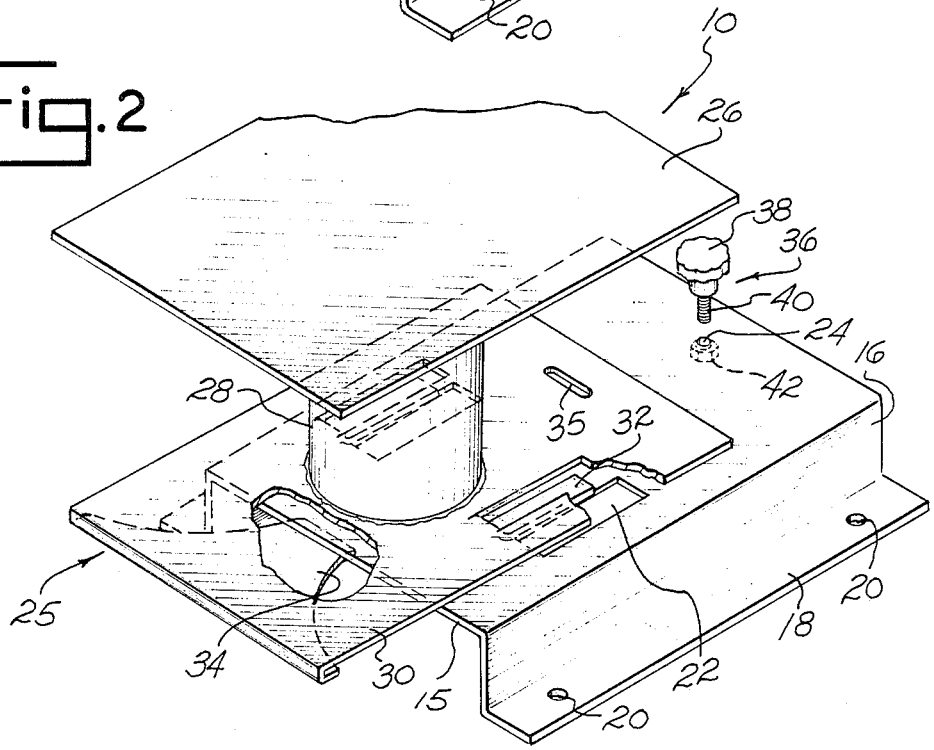
FIG. 2 is a fragmentary perspective view of the seat pedestal illustrating removal of the support plate from the base.

Guide plate 30 also defines a slot 34 which overlies bore 24 when the pedestal is assembled as shown in FIG. 1. A fastener 36, preferably having a threaded shank 38 and a turn knob 40, extends through slot 35 and bore 24 and mates with a threaded nut 42 or similar fastener which may be free floating or secured to the underside 17 of upper base plate 14 to firmly secure base member 12 to support plate 26 and support member 28.

To disassemble pedestal 10, fastener 36 is turned out of nut 42 and removed. Seat support 25 is then slide over upper base plate 14 until lip 34 clears base plate end edge 15 and tabs 32 are visible. Assembly 25 is then lifted up and out of contact with base member 14. To reassemble pedestal 10, assembly 25 is fitted atop base plate 14 with tabs 32 aligned with holes 24, and lip 34 positioned under the base plate. After sliding assembly 25 into the assembled position with tabs 32 and lip 34 positioned as shown in FIG. 3, fastener 36 is turned into nut 42 to secure the assembly to base member 12.

It is understood that the above description does not limit the invention to those details, and that it may be modified within the scope of the following claims.

I claim:

1. In a seat pedestal including a base member adapted for attachment to and having a raised portion spaced from a floor, and an upper plate means for supporting a chair positioned above said base member and supported above the base member by a generally tubular support, the improvement wherein said base member raised portion defines holes therethrough, said tubular support further including a lower plate member adjacently overlying said base member raised portion and having downturned tabs mateable with said holes to secure the tubular support to said base member, said lower plate member further including a peripheral return bent flap for engaging said base member raised portion to secure the tubular support to the raised portion.

2. The seat pedestal of claim 1 wherein said base member raised portion defines a threaded bore, a slot defined in said lower plate member overlying said threaded bore, and a fastening means extending through said slot into said threaded bore for securing the tubular support to the base member.

* * * * *